US012286852B2

(12) United States Patent
Abaza et al.

(10) Patent No.: US 12,286,852 B2
(45) Date of Patent: Apr. 29, 2025

(54) SYSTEM AND METHOD FOR MILLING PAST WELLBORE RESTRICTIONS

(71) Applicants: SAUDI ARABIAN OIL COMPANY, Dhahran (SA); NATIONAL PETROLEUM TECHNOLOGY COMPANY, Dammam (SA)

(72) Inventors: Bayan Abaza, Dhahran (SA); Othmane Mezabia, Alkhobar (SA)

(73) Assignees: SAUDI ARABIAN OIL COMPANY, Dhahran (SA); NATIONAL PETROLEUM TECHNOLOGY COMPANY, Dammam (SA)

( * ) Notice: Subject to any disclaimer, the term of this patent is extended or adjusted under 35 U.S.C. 154(b) by 35 days.

(21) Appl. No.: 18/315,635

(22) Filed: May 11, 2023

(65) Prior Publication Data

US 2024/0376794 A1 Nov. 14, 2024

(51) Int. Cl.

| | |
|---|---|
| ***E21B 29/00*** | (2006.01) |
| ***E21B 31/08*** | (2006.01) |
| ***E21B 34/06*** | (2006.01) |
| ***E21B 37/06*** | (2006.01) |

(52) U.S. Cl.

CPC ..... *E21B 29/002* (2013.01); *E21B 31/08* (2020.05); *E21B 34/06* (2013.01); *E21B 37/06* (2013.01); *E21B 2200/05* (2020.05)

(58) Field of Classification Search

CPC ..... E21B 31/002; E21B 31/08; E21B 29/002; E21B 29/02

See application file for complete search history.

(56) References Cited

U.S. PATENT DOCUMENTS

| | | | | |
|---|---|---|---|---|
| 8,716,197 | B2 | 5/2014 | Otto et al. | |
| 2010/0038142 | A1* | 2/2010 | Snyder | F04C 2/1071 175/57 |
| 2017/0335645 | A1* | 11/2017 | Merron | E21B 33/12 |
| 2018/0347361 | A1* | 12/2018 | Sicilian | F01C 1/101 |
| 2020/0362656 | A1* | 11/2020 | Fripp | E21B 7/061 |
| 2021/0140239 | A1* | 5/2021 | Miess | E21B 4/02 |

FOREIGN PATENT DOCUMENTS

CN 104847258 A 8/2015

OTHER PUBLICATIONS

Schlumberger Oilfield Glossary—Trip—https://glossary.slb.com/en/terms/t/trip (Year: 2024).*

Abdullah et al., "Cement Milling Using Incorrigible Corrosive Brine in an HPHT Environment: A Unique Case Study," Society of Petroleum Engineers, SPE-189912-MS, Mar. 2018, 14 pages.

(Continued)

*Primary Examiner* — David Carroll

(74) *Attorney, Agent, or Firm* — Osha Bergman Watanabe & Burton LLP

(57) ABSTRACT

Described is a system for milling past wellbore restrictions. The system includes multiple components axially connected to form a bottom hole assembly (BHA). The BHA includes an external coil connector, a motor head assembly (MHA), a metal-to-metal (MTM) motor, a bypass circulation valve (BCV), and a mill component.

7 Claims, 5 Drawing Sheets

(56) References Cited

OTHER PUBLICATIONS

Nunez et al., "Frac Plugs Milling Optimization in Depleted Gas Wells, from Learnings to Well Delivery Enhancement," Society of Petroleum Engineers, SPE-202910-MS, Nov. 2020, 8 pages.
Nunez et al., "Post Frac Cleanout and Plug Milling Optimization Strategy. Successful Implementation in Extremely Depleted Wells in the Sultanate of Oman," Society of Petroleum Engineers, SPE-206147-MS, Sep. 2021, 14 pages.
Thruster Energy Corporation Team, "Thruster Energy Corporation," 2020 Catalog, 70 pages.

* cited by examiner

SYSTEM AND METHOD FOR MILLING PAST WELLBORE RESTRICTIONS

BACKGROUND

Restrictions in casing boreholes are frequently encountered during well stimulation operations of long, horizontal laterals in unconventional natural gas assets. Restrictions are also encountered during milling operations of plugs, e.g., frac plugs. Frac plugs provide temporary zonal isolation during fracturing operations in vertical and horizontal completions. Reasons for restrictions include, geological movement, casing weakness, over-torqued connections, and casing damage due to frac plugs.

During normal milling operations, a mill with an outer diameter (OD) that is 93-96% of the casing inner diameter (ID) is typically used to ensure the plug debris is small enough to not accumulate behind the Bottom Hole Assembly (BHA), which may cause the coil to become stuck. Generally, a mill with an OD less than 93% may be considered an undersized mill. If a restriction is encountered while milling, a bi-centered mill that, ideally, revolves to 93-96% of the casing ID may be utilized. If the restriction is too severe, the use of an undersized mill, or bi-centered mill that revolves to an undersized mill size, may create large debris that accumulates around the coil, causing the coil to be stuck in the wellbore. Hence, the plugs isolating the subsequent stages will not be milled, and any production from the remainder of the stimulated lateral will be lost.

Certain plugs that are used in stimulation operations are highly dissolvable in acid. If acid can be pumped during the milling process while utilizing an undersized mill, the risk of a stuck coil can be mitigated. However, the internal components of the motors commonly utilized in milling BHAs contain rubber elements which may be severely damaged by pumping acid through the BHA. Additionally, the reduction in size of the BHA that is required for an undersized mill reduces the circulation rate through the coil tubing. A reduced circulation rate presents a problem when it comes to needing to circulate the milling debris out of the wellbore.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method for milling past wellbore restrictions. A milling bottom hole assembly (BHA) is positioned within a wellbore at a desired depth. The BHA may include a metal-to-metal (MTM) motor and a bypass circulation valve (BCV). An initial milling operation performed may include pumping a quantity of an acid into the wellbore and milling with the BHA. The method may further include determining whether an initial plug in the wellbore has been milled, and when the initial plug has been milled, proceeding with one or more subsequent milling operations with the acid. Following milling of a first predetermined number of plugs, a first trip is performed with the BHA past a restriction.

In another aspect, following the first trip, one or more additional milling operations are performed with the acid; and following milling of a second predetermined number of plugs, a second trip having a distance greater than the first trip is performed with the BHA.

In another aspect, the method includes determining whether debris is present in the wellbore. When debris accumulation is present, the BHA may perform a second trip having a distance greater than the first trip.

In another aspect, when debris accumulation is present, a BHA comprising a MTM motor and a venturi junk basket (VJB) is positioned within the wellbore at a desired depth. An amount of acid may be spotted across at least a section of the BHA comprising the VJB, where the acid is allowed to dissolve the debris for a predetermined amount of time, and debris is removed in the wellbore via a suction mechanism using the VJB. In some cases, an agitation effect may be performed with the MTM motor of the BHA comprising the VJB to lift the debris in the wellbore.

In another aspect, embodiments disclosed herein relate to a system for milling past wellbore restrictions. The system includes a plurality of components axially connected together to form a milling BHA. The plurality of components may include an external coil connector formed to connect with a coil string, a motor head assembly (MHA) connected with the external coil connector, a MTM motor, a BCV positioned above the MTM motor, and a mill component. The mill component may be a bi-centered mill, an undersized mill, or a burn shoe, for example, and may have an outer diameter ranging from about 2 inches to about 3 inches. The MHA may include dual flapper valves and a circulation sub component. The MTM motor may be a progressive cavity positive displacement pump configured to rotate the mill component. The BCV may be a Multi-Cycle Circulating Valve (MCCV).

In another aspect, the system further includes at least one of one or more jars, an accelerator, a lower disconnect component positioned below the one or more jars, an extended reach agitator, a venturi junk basket (VJB), and a VJB extension.

Other aspects and advantages of the claimed subject matter will be apparent from the following description and the appended claims.

DETAILED DESCRIPTION

Figure 1:
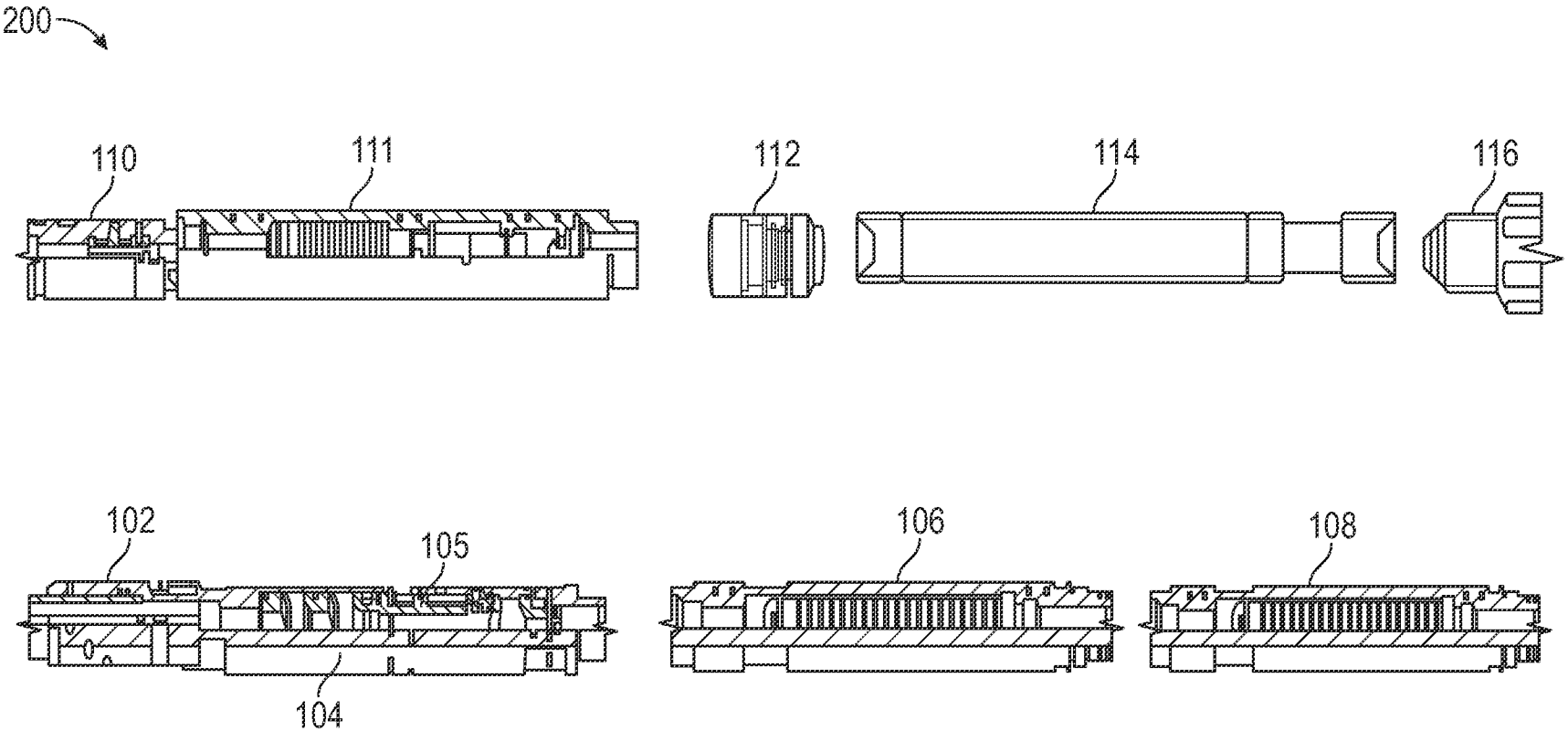
FIG. 1 is an illustration of a milling Bottom Hole Assembly (BHA) with a metal-to-metal (MTM) motor and a Bypass Circulation Valve (BCV) according to one or more embodiments of the present disclosure.

In one aspect, embodiments disclosed herein relate to a method for perform milling operations in a wellbore with restrictions. In another aspect, embodiments disclosed herein relate to a Bottom Hole Assembly (BHA) that may be sized and configured to circumvent restrictions in a wellbore without becoming stuck in the wellbore.

In one or more embodiments, due to severe casing restrictions, an undersized mill may be used to mill acid dissolvable plugs. Specifically, a mill and/or BHA having an outer diameter (OD) smaller than typically used mills and BHAs may be utilized in order to fit through tighter areas in the wellbore caused by one or more restrictions. For example, in typical operations, a mill and BHA may include using a 2⅞ inch BHA in a 4.5 inch wellbore and 5.5 inch casing strings utilizing a 3.5 inch junk mill for a 4.5 inch casing, or a 4.25 inch or 4.375 inch junk mill for a 5.5 inch casing. In contrast, when using methods disclosed herein, in one or more embodiments, a 2⅛ inch BHA and 5.5 inch casing strings utilizing a 2.6 inch junk mill or offset mill that revolves from 2.625 inch to 3.25 inch OD may be used in 4.5 inch wells.

BHAs may be assembled from multiple components connected together in an end-to-end fashion, where each component may have a specialized function. For example, BHAs according to one or more embodiments of the present disclosure may have a mill component (e.g., a burn over/washover shoe, a reamer, a mill, etc.) for milling action, a motor (e.g., a metal-to-metal (MTM) motor) for rotating the mill component or creating agitation in embodiments using a Venturi Junk Basket (VJB), and a string connector (e.g., for connecting the BHA to a coil). As can be appreciated by one skilled in the art, the BHA may include any and all components standard to a BHA including, but not limited to, a coil connector to connect the coil to the BHA, a motorhead assembly (MHA) (dual flapper valves, hydraulic disconnect, and circulation sub), a jar and accelerator, a lower disconnect below the jars, and an extended reach tool. The BHA may additionally include any components necessary for it to perform its intended function, such as a milling component, a VJB component, a fishing component, and a nozzle component.

In one or more embodiments, the configuration of the BHA may include a downhole Bypass Circulation Valve (BCV). The BCV may be a Multi-Cycle Circulating Valve (MCCV), which is activated by varying the pump rate down the coil, or the BCV may be a set down valve, which is open by default unless weight is put on it from the coil behind it once pushed against a plug. If the motor size creates a choke point to the circulation rate, then a BCV may be used to ensure sufficient circulation exists to prevent debris accumulation. Components of BHAs according to one or more embodiments of the present disclosure are described in more detail below.

In milling applications, the mill component of the BHA has the largest OD of the components of the BHA in order to avoid creating debris that may accumulate around the BHA and cause a stuck coil problem. In order to avoid getting stuck, the mill according to embodiments of this disclosure is smaller in size than is typically used for the same size well. For example, in mill operations according to embodiments of the present disclosure, a mill may have an OD less than 70 percent of the ID of the well (e.g., ID of the well casing), e.g., a mill OD may be selected from a size ranging between 40 and 60 percent of the casing ID. As an example, in a 5.5-inch casing, a mill may have an OD of 2.6 inch or 3.0 inch for an offset mill when used according to embodiments of the present disclosure. In contrast, in a typical milling operation, a mill may have an OD that rotates to greater than 90 percent of the casing ID. As an example, in a 5.5-inch casing, a typically sized mill may have an OD of 4.25 inch to 4.375 inches.

The size of the restriction in the wellbore dictates the size of the mill, which, in turn, dictates the size of the BHA. For instance, the outer diameter of the BHA may be in a range of about 2 inches to about 3 inches, such as in a range of about 2⅛ inches to about 2⅞ inches. In such embodiments, the BHA may include a 2.6 inch mill on a 2⅛ inch BHA connected to a 2 inch OD coil in 5.5-inch casing. Alternatively, the BHA may include a 3.00-inch offset mill on a 2⅞ inch BHA with a 2⅜ inch coil also in 5.5-inch casing. Typical mills have larger ODs, such as 4.25 inches to 4.375 inches on a 2⅞ inch in 5.5-inch casing. Additionally, the OD of the coil is significant. For long laterals, a larger OD coil (e.g., at least 2⅜ inch) may be required. Because a larger OD coil size may prove difficult for some vendors' BHAs due to the potential of bending the BHA, a smaller size coil (e.g., 2 inch with a 2 1/16 inch BHA) may be used, in which case, an extended reach component is required.

However, when using a smaller size BHA to fit through restrictions in the wellbore, as described above, the BHA may become a choke point for fluids flowing through the connected string (e.g., coil). The choke point may increase the circulating pressure inside the coil, reducing the much-needed circulation rate to clean out the debris. In one or more embodiments, a BHA configuration includes a BCV to aid in the removal of the debris. Additionally, given the risky nature of milling operations, even when the BHA is not undersized for the casing size, the added circulation rate mitigates the risk of debris accumulation across the restriction.

In another embodiment, if the proper circulation and removal of the debris cannot be achieved with the milling BHA, then a Venturi Junk Basket (VJB) with an MTM motor may be utilized as part of the BHA. The VJB may be utilized to remove debris in the wellbore via a suction mechanism. The MTM motor may allow acid to be spotted across a section of the well, enabling the dissolution of the plug debris to reduce size of the debris and allow the debris to better pass through the mill component (e.g., a burn (or burn over) shoe) ID into the BHA. Additionally, the MTM motor may provide an agitation effect to lift the remaining debris, thereby enhancing the cleaning effect of the VJB. The presence of the mill component may provide a milling action for any leftover debris.

FIG. 1 illustrates an exploded view of one embodiment of a milling BHA (100) configuration formed according to one or more embodiments of the present disclosure. In one or more embodiments, each of the components is connected to another via a threaded male-female connection in an end-to-end fashion. As shown, the BHA (100) comprises an external coil connector (102) formed to connect the BHA (100) with the coil string. In one or more embodiments, the coil string is a continuous length of low-allow carbon-steel tubing that may be deployed into a wellbore for the placement of fluids or manipulation of tools during well operations, such as milling. A Motor Head Assembly (MHA) (104), including dual flapper valves, is connected with the external coil connector (102) to prevent back flow in case the coil string needs to be disconnected from the BHA. The MHA (104) may further include a disconnect component in the event the BHA (100) is stuck and the coil string needs to be disconnected from the BHA (100). A circulation sub component (105) in the MHA (104) may be used in the event circulation needs to be established above the BHA (100) at a higher rate than through the motor. In one or more embodiments, the BHA (100) may include an accelerator (106). The BHA (100) may further include one or more jars (108) that apply a sudden high impact force down hole when activated. A jar may include an internal hammer or dynamic component that may be mechanically or hydraulically activated to move (e.g., to strike up, down, or both), where the movement of the internal hammer moves the jar. The jars (108) are primarily used if the BHA (100) becomes stuck, where movement of the jar may be needed to dislodge the stuck BHA. The accelerator (106) may intensify an axial force applied by the jars (108).

The BHA (100) may further include a lower disconnect (110). The lower disconnect (110) is added in the event that jars (108) are added to avoid leaving the jars (108) in the wellbore if the BHA (100) becomes stuck, which may complicate a subsequent fishing operation. An extended reach agitator (111) may extend the reach of the coil string by mitigating the effects of pipe-to-pipe friction. For instance, some extended reach agitators (111) generate pulses that create axial movement forward.

In addition, the BHA (100) may include a Bypass Circulation Valve (BCV) (112). In one or more embodiments, the BCV (112) may be a weight- or rate-activated valve that is placed above the motor and configured to allow circulation at a higher rate than if just pumped through the motor. Different configurations of Bypass Circulation Valves (BCVs), weight activated, or rate activated, may be used to bypass the restrictions on a circulation rate imposed by the BHA during coil operations.

The BHA (100) also includes a Metal-to-Metal (MTM) motor (114). In some embodiments, the MTM motor (114) may be a progressive cavity positive displacement pump that rotates via a fluid pumping mechanism and, in turn, rotates the mill component. The internal components of the MTM motor (114) may be entirely rubber free (i.e., no rubber components), thereby allowing corrosive fluids to be pumped through the MTM motor (114). The absence of the rubber element on the stator leads to a higher temperature resiliency (i.e., no swelling due to temperatures) and longer operating time (i.e., no malfunctioning due to rubber chunks hindering the motor while milling).

The BHA (100) further includes a mill (116) which may be any size or shape depending on the intended application. The mill (116) contains nozzles from which fluid being pumped downhole may flow. Depending on the downhole operation being conducted, different types of fluid may be pumped downhole through the BHA (100) and out of the nozzles. For example, during a milling operation, water is pumped downhole through the string and connected BHA and ejected out of nozzles to circulate the generated debris out of the wellbore. In some applications, such as while milling plugs past a restriction, an acidic fluid may be pumped downhole through the BHA and out of the nozzles to dissolve a dissolvable plug or other impediment in the wellbore. The presence of the MTM motor (114) in accordance with embodiments of the present disclosure allows pumping of the corrosive/acidic fluid.

Generally, during conventional milling operations, when a plug is tagged (identified), such as due to an observed weight decrease on the surface and/or a circulation pressure increase, milling operations may commence by applying weight on bit (WOB) and maintaining the differential pressure across the motor at an optimum range. Once the surface weight returns to normal, differential pressure across the motor may decrease, and the coil depth may increase. Then, the plug setting depth may be drilled through and a viscous gel pill may be pumped to the setting depth of the plug to flush out the plug debris. This process may be repeated for the subsequent plug. After a certain number of plugs are milled, a short distance trip back (e.g., 1,000 to 2,000 feet (ft)) while pumping in the wellbore may be performed to prevent the accumulation of debris. The process may then be repeated and a longer distance trip (i.e., a distance greater than the first trip) may be performed to recover as much debris as possible and prevent the coil string from becoming stuck in the wellbore. The longer distance trip is in a backward direction towards the surface of the wellbore to sweep the debris generated from the milling process back to the surface. For example, when drilling through plugs in a horizontal well, a longer distance trip may include pulling the BHA backwards through a horizontal section of a well all the way to (or close to) the vertical section of the well leading to the surface.

In contrast to conventional methods of milling a plug, when utilizing BHAs (100) having a MTM motor (114) and an undersized mill (116), an acid slug may be pumped when the plug setting depth is reached regardless of whether the plug is tagged. If the plug is tagged, the coil may be pulled back slightly, and acid may be pumped from the surface. When acid reaches the tip of the mill (116), milling may commence by applying WOB and maintaining the differential pressure across the MTM motor (114). The differential pressure may be maintained at a pre-determined optimal range similar to the conventional milling process described above. Additional acid slugs/pills may be pumped if progress is slow. Once the plug is milled, a gel fluid sweep may be pumped to "sweep" up the debris and carry the debris to the surface. The procedure may be repeated on a subsequent plug. After a pre-determined number of plugs have been milled, a short sweep (fluid pumping) past the restriction may be performed and milling operations may commence.

A long sweep to the vertical may be necessary after a subsequent set of plugs is milled. The number of plugs necessary for performance of a short or long sweep may be adjusted based on a number of factors, including the mill times of the plugs (i.e., how long it takes to mill the plugs) and an amount of solid debris recovered on the surface. Additionally, a sweep may be performed if there is an indication of debris accumulation, which may occur while performing pull tests at regular intervals. The volume and frequency of the acid slugs may also be optimized based on progress. The size of the MTM motor (114) may create a restriction to flow through the BHA (100), thereby reducing the flowrate through the mill (116). The presence of the BCV (112) allows for fluid bypass around the MTM motor (114), which may allow for a higher fluid circulation rate through the BHA (100) when not milling plugs.

Methods according to one or more embodiments of the present disclosure rely on frequent trips past a restriction based on debris recovered on the surface in order to avoid debris accumulation. As described above, the BCV (112) allows for bypassing the MTM motor (114) and generating an increased circulation rate in order to mitigate the risk of debris accumulation around the restriction. If a bi-centered mill is needed to mill the plugs, the increased circulation rate provided by the BCV (112) may ensure no debris accumulation when the fluid pumping shuts down to allow the BHA (100) to pass through the restriction. As described above, the decreased OD of the BHA (100), compared to conventional BHAs, as well as its configuration provides a BHA (100) that performs milling operations in the presence of restrictions and without becoming struck during operation.

Debris collectors on the surface in the return line are checked regularly for returning debris. For instance, if after milling several plugs, no plug debris is recovered on surface, that is an indication of debris accumulation downhole. Additionally, while performing short trips or pull tests, an increase in weight may be noticed if debris is accumulating and not being removed. If sufficient debris removal via circulation cannot be achieved, a secondary option may utilize a Venturi Junk Basket (VJB) with a MTM motor.

Figure 2:
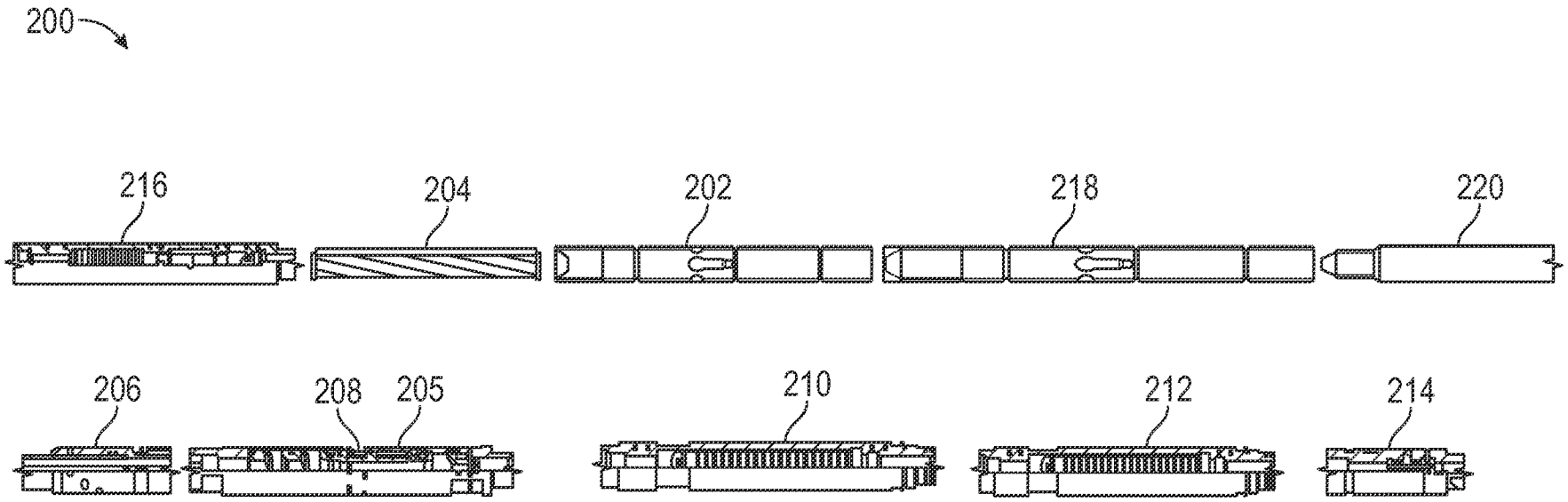
FIG. 2 is an illustration of a BHA with a Venturi Junk Basket (VJB) and MTM motor according to one or more embodiments of the present disclosure.
Figure 3:
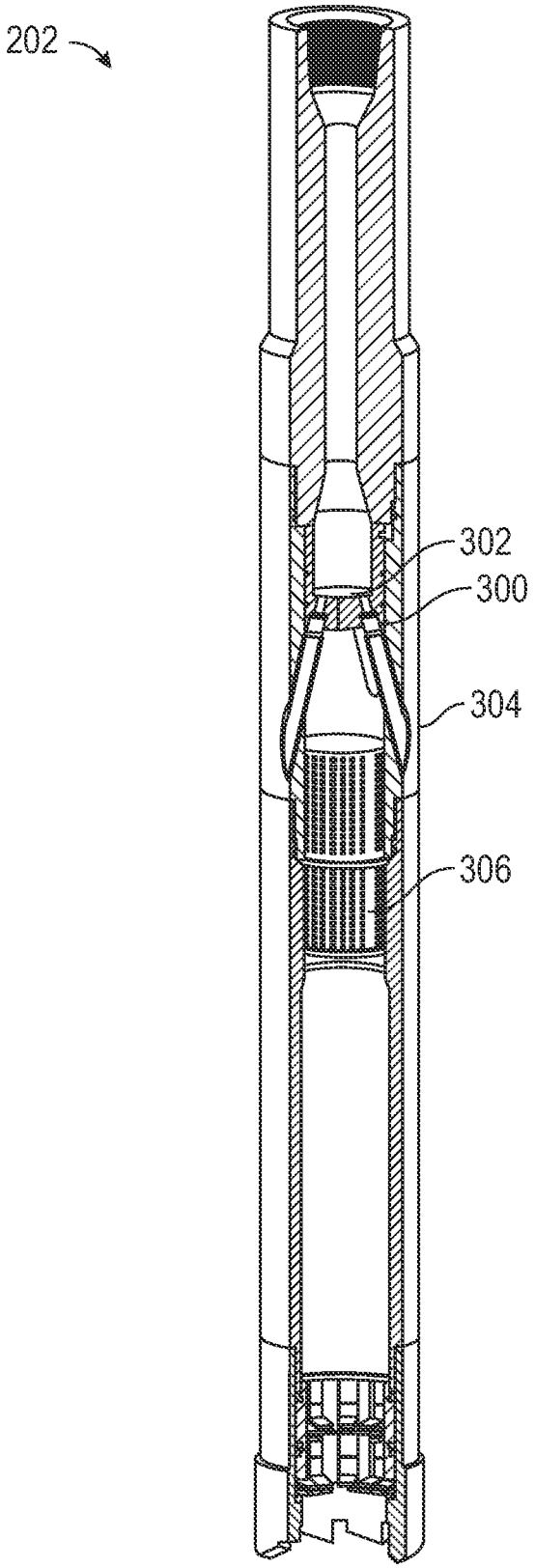
FIG. 3 is an illustration of a VJB according to one or more embodiments of the present disclosure.

FIG. 2 illustrates an embodiment of a BHA (200) including a VJB (202). A VJB (202) is used to retrieve debris from the wellbore via creation of a vacuum effect. The VJB (202) may remove the debris via a suction action that accumulates small debris inside the BHA (200) itself. FIG. 3 depicts an exemplary VJB (202). In one or more embodiments, the VJB (202) may comprise a plurality of nozzles (300) within a housing (302) and a Venturi chamber (304). When fluid is pumped through coil tubing to the Venturi chamber (304), one or more of the nozzles (300) may direct the flow to an outer diameter of the BHA. A vacuum is created in the Venturi chamber (304) such that fluid and debris may be drawn to the bottom of the BHA. A debris component, such as a debris screen (306), may hold the debris inside the BHA. By combining a VJB with a MTM in a BHA, acid may be pumped through the BHA according to methods disclosed herein.

Referring again to FIG. 2, given that the debris may not be small enough to be easily removed by the VJB (202), acid, such as inhibited 15% hydrochloric acid (HCl), 10% HCl, or 20% HCl, may be pumped from the surface through the string assembly to help diminish the size of the debris. The presence of a MTM motor (204) allows for pumping the acid while also providing agitation to enhance the cleaning performance from the vacuum effect of the VJB (202). When the desired depth is reached, acid may be spotted from the BHA (200) across a section of the wellbore at low rates. In this context, spotting refers to laying out acid across a section of the wellbore where debris exists. Acid may then be left in the wellbore for a period of time to allow the acid to dissolve as much of the debris as possible. The time the acid is left is dependent upon the plug dissolution rate, which is based on the composition of the debris and the downhole temperature. Coil may be then Run In Hole (RIH) while pumping at a maximum rate across the same section that the acid was spotted across before returning to surface. RIH refers to the process of lowering the connected length of pipe/coil into a wellbore in a controlled manner.

In one or more embodiments, the VJB BHA (200) includes a coil connector (206), which connects the VJB BHA (200) to the coil. A motor head assembly (MHA) (208) is also a component of the VJB BHA (200). The MHA (208) contains dual flapper valves to prevent back flow in case the coil string needs to be disconnected from the VJB BHA (200). In addition, the MHA (208) includes a disconnect sub in the event the VJB BHA (200) is stuck and the coil string needs to be disconnected. A circulation sub component (205) may also be included in the MHA (208). The circulation sub component (205) is activated by either dropping a ball from surface or increasing the pressure to a set limit that activates a burst disc, thereby opening a flow path in the event that the BHA circulation path becomes blocked. Additionally, the circulation sub component (205) may provide an alternative flow path in the event the normal flow path through the motor becomes plugged or may provide a higher flow rate then what the motor can afford is needed. Once activated, the circulation sub component (205) needs to be pulled to surface to be re-set.

In some embodiments, the VJB BHA (200) may include an accelerator (210) which intensifies the axial force applied by the jars (212). The jars (212) may apply a sudden high impact force down hole when activated. The jars (212) are primarily used if the VJB BHA (200) becomes stuck. If jars (212) are utilized, a lower disconnect (214) may be placed below the jars (212) to prevent having the jars (212) left in the wellbore. The VJB BHA (200) may further include an extended reach agitator (216) which extends the reach of the coil string by mitigating the effects of pipe-to-pipe friction. The MTM motor (204) may be a progressive cavity positive displacement pump that rotates by pumping fluid through the motor to rotate the VJB (202), a VJB extension (218), and a mill component such as a burnover/washover shoe, or burn shoe (220). The internal components do not have any rubber components so that corrosive fluids may be pumped through it. The VJB (202) may provide suction action at the tip of the VJB BHA (200) entrance. The VJB extension (218) may be included as collection bins for the debris to allow collection of a larger volume of debris. The burn shoe (220) is a mill component providing milling action to the debris. The burn shoe (220) may include jagged tips or cutting elements provided along the outer circumference of its face to crush surrounding debris.

Restrictions in casing boreholes are frequently encountered during well stimulation operations of long, horizontal laterals in unconventional natural gas assets. Restrictions are also encountered during milling operations of plugs used to isolate sequential stages in the horizontal laterals. Reasons for restrictions may include, for instance, geological movement, casing weakness, over-torqued connections, and casing damage (i.e., deformation in a horizontal lateral) due to plugs.

Figure 4:
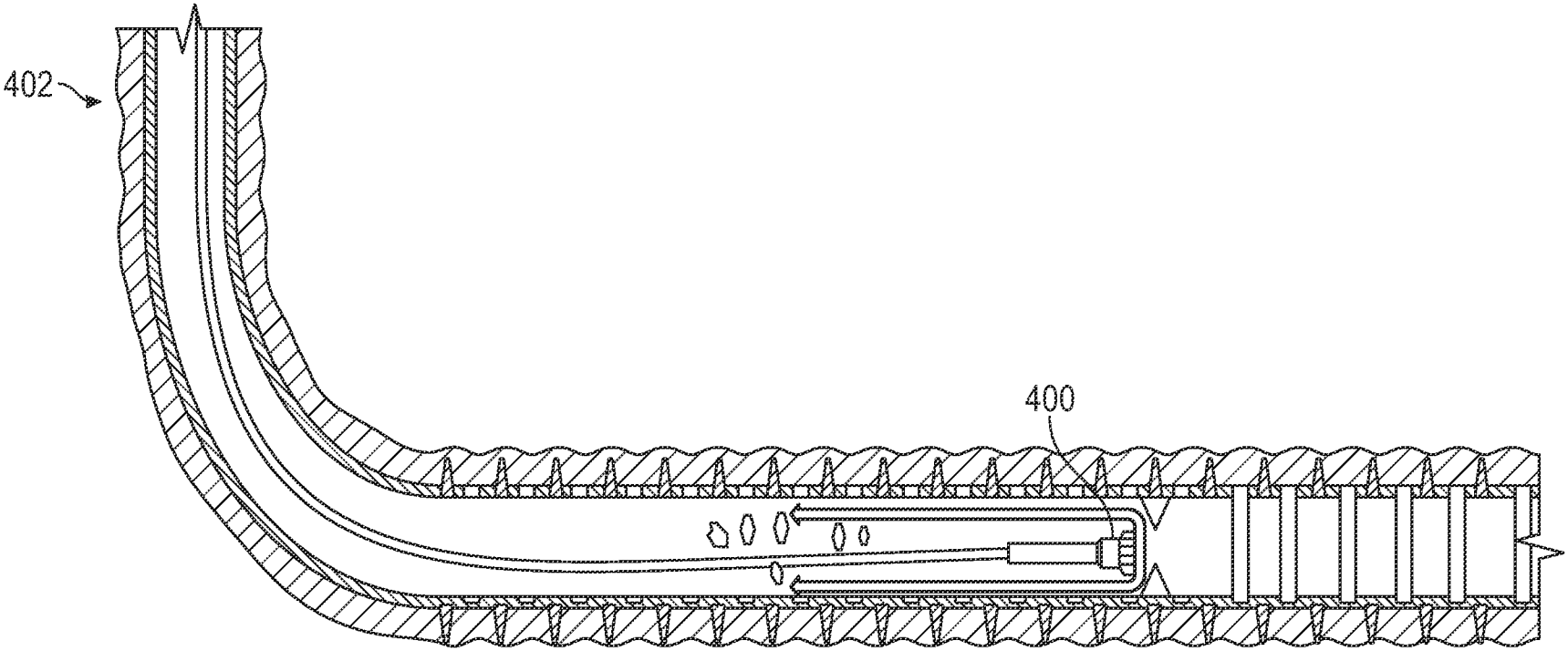
FIG. 4 is an illustration of a wellbore restriction according to one or more embodiments of the present disclosure.

FIG. 4 depicts an example of a well restriction which is encountered post stimulation and during milling where the restriction cannot be passed by a conventional or bi-centered mill that can rotate to approximately 93-96% of the casing borehole (402) inner diameter (ID). During such scenarios, a mill (400), such as a bi-centered mill, with a rotating outer diameter (OD) that is less than 93-96% of the casing borehole (402) inner diameter (ID), or a junk mill with an OD which is also significantly smaller than the restricted casing ID, is needed to pass the restriction and remove the remaining plugs isolating the remaining lateral.

As described above, running an undersized mill runs the risk of generating large size plug debris that may accumulate and cause the coil to become stuck in the wellbore. Certain plugs used in stimulation operations are highly dissolvable in acid. If acid can be pumped during the milling process while utilizing an undersized mill, the risk of stuck coil can be mitigated. However, the internal components of the commonly used motors utilized in milling BHAs contain rubber elements which will be severely damaged by pumping acid through the BHA. Additionally, the potential reduction in size of the BHA that is required reduces the circulation rate through the coil, presenting a problem when it comes to needing to circulate the milling debris out of the wellbore.

Thus, utilizing a MTM motor in conjunction with a BCV in a milling BHA that requires a significantly smaller OD then what is conventionally used has several advantages. The ability to pump acid through the milling BHA while milling dissolvable plugs may enable a reduction in the size of the plug parts. The risk of getting the coil string stuck downhole may be mitigated. Additionally, the use of a BCV may enable higher rates of pumping, improve the rate of circulation (represented by arrow 312), and ultimately reduce the number of short and long trips back and forth through the restriction. Thus, the combination of a MTM motor and a BCV allows access to the wellbore past a restriction in circumstances that would not be possible using conventional BHA configurations. In contrast, in conventional operations, the wellbore produces with only the milled portion of the lateral or is abandoned completely.

Figure 5:
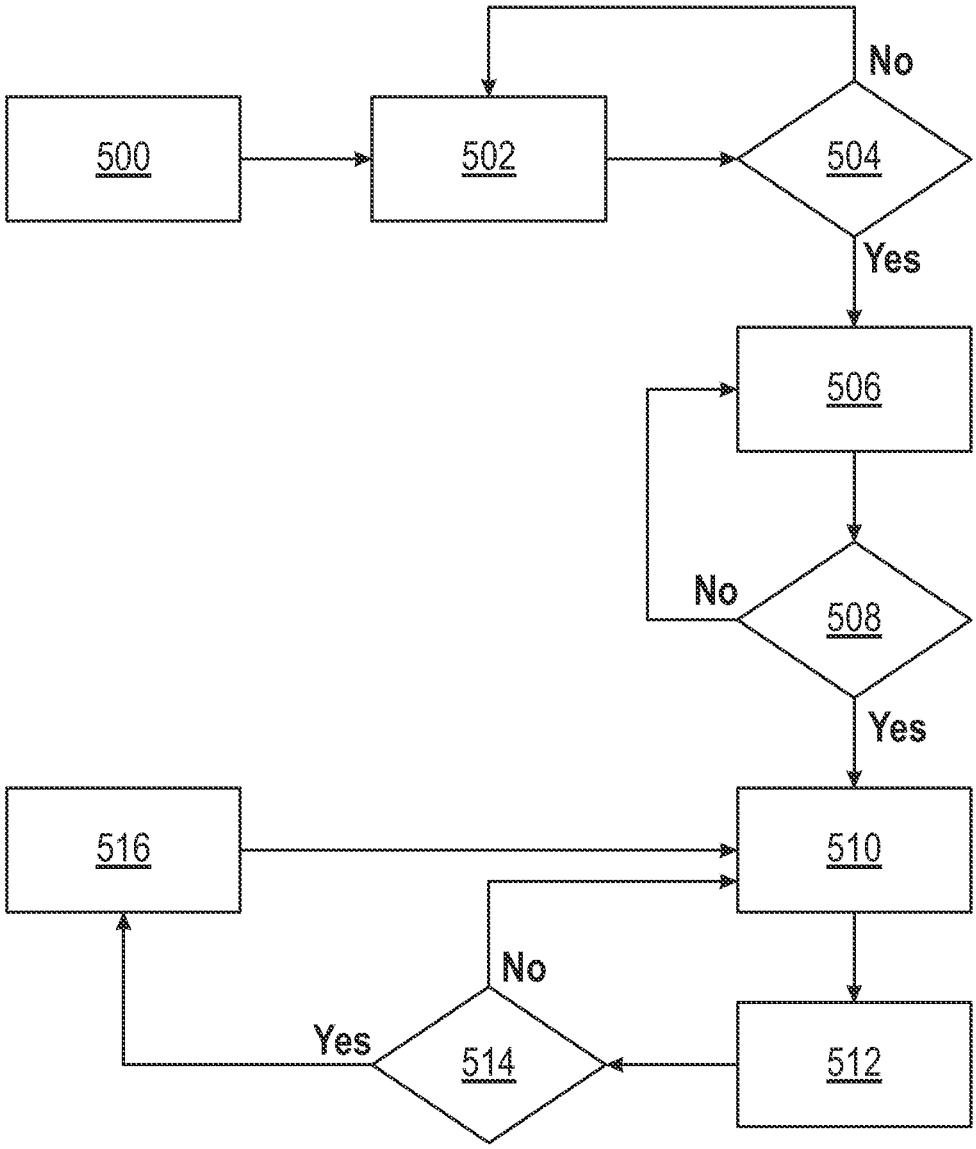
FIG. 5 is a flow diagram illustrating a process for milling past wellbore restrictions according to one or more embodiments of the present disclosure.

The flowchart in FIG. 5 illustrates a method for milling past a restriction according to some embodiments of the present disclosure. The size of the BHAs used depends on the size of the restriction and the size of the mills to be used.

First, a RIH is performed with a milling BHA to a desired plug depth in step (500). Once the plug is tagged, an acid pill with a definite volume (e.g., 5-15 bbls of 15% HCl) is pumped into the wellbore, and an initial milling operation commences in step (502). A first determination may be made regarding whether the initial plug has been milled in step (504). Reduction in circulation pressure, the absence of coil weight loss and/or weight gain while milling, and the ability to pass the plug depth are all indications that the plug has been successfully milled. If the plug has not been milled, the process may return to step (502). If the plug has been milled, then the process may proceed to the next plug, and the milling process may be repeated with acid in step (506). Subsequently, a second determination may be made regarding whether the plug has been milled in step (508). In step (510), after a predetermined number of plugs is milled, a short trip past the restriction may be performed, and milling is resumed. If no debris is recovered and signs of debris accumulation are perceived, a long trip backwards to the vertical may be warranted. A long trip to the vertical is past the restriction and out of the wellbore to 0 degrees inclination. After approximately twice the number of plugs is milled with acid, a long trip to the vertical may also be performed in step (512). The number of plugs milled before performing the long trip to the vertical depends on the debris recovery and whether the coil tubing encounters an over pull during a pull test.

Next, in step (514), a determination may be made whether there are any indications of debris accumulation from the milled plugs. If not, the process may return to step (510). If there are indications of debris accumulation, then the process may proceed to step (516), where the VJB BHA (including MTM motor) may be RIH. In addition, acid pill may be spotted across the lateral section of the wellbore and left to soak for a predetermined amount of time (e.g., about twenty minutes). RIH pumping may be performed at a maximum rate that depends on the wellbore pressure and the size of the return line choke on surface. Then, a clean out run may be performed. Subsequently, the process may return to step (510). Each of the steps of the method is performed slowly and carefully, as the goal is not efficiency, but avoiding the coil from becoming stuck in the borehole.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method for milling past wellbore restrictions, the method comprising:

positioning a milling bottom hole assembly (BHA) within a wellbore at a desired depth, the BHA comprising a metal-to-metal (MTM) motor and a bypass circulation valve (BCV);

moving the BHA in a forward direction through a restriction in the wellbore toward an initial plug;

performing an initial milling operation, wherein the initial milling operation comprises:

pumping a quantity of an acid into the wellbore; and milling the initial plug with the BHA;

when the initial plug has been milled, then proceeding with one or more subsequent milling operations with the acid;

following milling of a first predetermined number of plugs, performing, with the BHA, a first trip, having a first distance, wherein the first trip comprises moving the BHA in a backward direction past the restriction.

2. The method of claim 1, further comprising:

following the first trip, proceeding with one or more additional milling operations with the acid;

following milling of a second predetermined number of plugs, performing, with the BHA, a second trip having a distance greater than the first trip, wherein the second trip comprises moving the BHA in the backward direction toward a surface of the wellbore.

3. The method of claim 1, further comprising determining whether debris is present in the wellbore.

4. The method of claim 3, wherein when debris accumulation is present, performing, with the BHA, a second trip having a distance greater than the first trip, wherein the second trip comprises moving the BHA in the backward direction toward a surface of the wellbore.

5. The method of claim 3, wherein when debris accumulation is present, positioning a second BHA comprising a second MTM motor and a venturi junk basket (VJB) within the wellbore at a desired depth.

6. The method of claim 5, further comprising:

spotting an amount of acid across at least a section of the second BHA comprising the VJB;

allowing the acid to dissolve the debris for a predetermined amount of time; and using the VJB, removing the debris in the wellbore via a suction mechanism.

7. The method as in claim 5, further comprising performing, with the second MTM motor of the second BHA comprising the VJB, an agitation effect to lift the debris in the wellbore.

* * * * *